US006844525B2

(12) United States Patent
Yoshikawa et al.

(10) Patent No.: US 6,844,525 B2
(45) Date of Patent: Jan. 18, 2005

(54) GLOW PLUG AND GLOW-PLUG-MOUNTING STRUCTURE

(75) Inventors: Takaya Yoshikawa, Aichi (JP); Hiroyuki Suzuki, Aichi (JP); Masakazu Nagasawa, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 10/714,809

(22) Filed: Nov. 17, 2003

(65) Prior Publication Data

US 2004/0124754 A1 Jul. 1, 2004

(30) Foreign Application Priority Data

Dec. 26, 2002 (JP) ..... 2002-376648

(51) Int. Cl.[7] ..... F23Q 7/00
(52) U.S. Cl. ..... 219/270; 219/541; 219/544
(58) Field of Search ..... 219/270, 541, 219/544, 545; 123/145 A, 145 R

(56) References Cited

U.S. PATENT DOCUMENTS

| | | | | | |
|---|---|---|---|---|---|
| 6,111,223 | A | * | 8/2000 | Tatematsu | 219/270 |
| 6,204,481 | B1 | * | 3/2001 | Ito | 219/270 |
| 6,326,595 | B2 | * | 12/2001 | Taniguchi et al. | 219/270 |
| 6,335,516 | B1 | * | 1/2002 | Muller et al. | 219/270 |
| 6,359,261 | B1 | * | 3/2002 | Watanabe et al. | 219/270 |
| 6,363,898 | B1 | * | 4/2002 | Ripma et al. | 123/169 R |
| 6,414,273 | B1 | * | 7/2002 | Taniguchi et al. | 219/270 |
| 6,483,079 | B2 | * | 11/2002 | Sato et al. | 219/270 |
| 6,646,231 | B2 | * | 11/2003 | Hotta et al. | 219/270 |
| 6,653,601 | B2 | * | 11/2003 | Taniguchi et al. | 219/270 |
| 6,657,166 | B2 | * | 12/2003 | Funaki et al. | 219/270 |
| 6,660,971 | B2 | * | 12/2003 | Terada et al. | 219/270 |
| 6,689,990 | B2 | * | 2/2004 | Taniguchi et al. | 219/270 |
| 2002/0130121 | A1 | | 9/2002 | Taniguchi et al. | 219/270 |
| 2002/0144990 | A1 | | 10/2002 | Haussner et al. | 219/270 |

FOREIGN PATENT DOCUMENTS

| | | |
|---|---|---|
| DE | 101 17 641 | 10/2002 |
| JP | 2001-324141 | 11/2001 |
| JP | 2002-276942 | 9/2002 |

* cited by examiner

*Primary Examiner*—Robin O. Evans
*Assistant Examiner*—Vinod Patel
(74) *Attorney, Agent, or Firm*—Kusner & Jaffe

(57) ABSTRACT

In a glow plug configured such that a metallic, tubular member having a heater fixedly provided therein is joined to a metallic shell, an external-thread portion is formed on the outer circumferential surface of the metallic shell so as to allow the glow plug to be screwed into a plug-mounting hole formed in an engine head. An annular protrusion is formed on the outer circumferential surface of the metallic, tubular member in such a manner as to protrude radially outward, to annularly extend in the circumferential direction, and to be located in the vicinity of a distal end of the metallic shell. A distally-facing end face of the annular protrusion abuts an annular seat face in the mounting hole, and the metallic, tubular member and the metallic shell are joined such that a distal end face of the metallic shell abuts a rearward-facing end face of the annular protrusion.

8 Claims, 7 Drawing Sheets

GLOW PLUG AND GLOW-PLUG-MOUNTING STRUCTURE

FIELD OF THE INVENTION

The present invention relates to a glow plug used for promoting start-up of, for example, a diesel engine and to a structure for mounting the glow plug.

BACKGROUND OF THE INVENTION

A conventional glow plug disclosed in, for example, Japanese Patent Application Laid-Open (kokai) No. 2001-324141 includes a shaft-like heater having an embedded resistance-heating element (resistance-heating wire), which generates heat when electrically energized; a metallic, tubular member in which the heater is fixedly provided through press fitting, shrink fitting, brazing, or the like such that a distal end portion of the heater protrudes from the metallic tubular member; and a tubular, metallic shell in which the metallic, tubular member is fixedly provided such that a distal end portion of the metallic, tubular member protrudes from the metallic shell. In the glow plug, two electrodes (terminals) that are connected to the resistance-heating element (resistance-heating wire) via respective junction wires are embedded in the heater in such a manner as to be exposed at a rear end portion of the heater. To one of the two electrodes is connected a lead wire that is connected to a center rod protruding from a rear end of the metallic shell while being electrically insulated from the metallic shell. In the glow plug, an end of the lead wire is connected to a tubular, metallic piece, and the tubular, metallic piece is shrink-fitted to the heater at a portion where the electrode is exposed, thereby establishing connection between the lead wire and the electrode. Meanwhile, the inner surface of the metallic, tubular member is in press contact with the other electrode, thereby establishing connection between the electrode and the metallic shell.

Such a glow plug is inserted into a plug-mounting hole (hereinafter may be called simply a mounting hole) formed in an engine head (cylinder head). A mounting external-thread portion formed on the outer circumferential surface of the metallic shell is screwed into an internal-thread portion formed in the mounting hole. An annular seat face that is tapered similarly to a distal end of the metallic shell is formed at a portion of the mounting hole located deeper toward an engine combustion chamber than the internal-thread portion. The annular seat face limits screwing movement of the metallic shell to thereby position the metallic shell, and establishes gastightness between the interior and the exterior of the combustion chamber. A distal end face (hereinafter may be called an end face) of the metallic shell that is screwed into the engine head is pressed against the annular seat face, whereby the metallic shell is positioned, and gastightness is established.

In the course of use of such a glow plug, heat generated through heat-generating action of the glow plug itself and heat associated with combustion of the engine raise the temperature of not only a distal end portion (a portion corresponding to the resistance-heating element) of the heater, but also a rear end portion of the heater where the electrodes (terminals) are exposed. As mentioned previously, for example, press contact is employed for respectively connecting the electrodes to the lead wire (tubular, metallic piece) and the metallic, tubular member. Subjection of the electrodes to repeated heat cycles in the course of use of the glow plug raises a problem of an increase in the contact resistance of the electrodes. In order to prevent such an increase in contact resistance, heat generated in the course of use of the glow plug must be efficiently released to the engine head so as to avoid excessive temperature increase at a portion of the heater where the electrodes are present. However, in the above-described glow plug and structure for mounting the glow plug, heat of the heater is conducted to the engine head via the metallic, tubular member fitted to the outer circumferential surface of the heater, the metallic shell, and the annular seat face in contact with the distal end face of the metallic shell and formed in the mounting hole, thereby involving a problem of inefficient heat conduction. Furthermore, in the conventional glow plug, since the metallic, tubular member is fixedly provided in the metallic shell through press fitting or the like, the degree of closeness of the joint surfaces depends on the tolerances of the inside and outside diameters of the metallic, tubular member and the metallic shell, surface roughness, and the like. Therefore, thermal conductivity differs among glow plugs, and high thermal conductivity cannot be obtained.

Japanese Patent Application Laid-Open (kokai) No. 2002-276942 (FIG. 2) discloses another glow plug in which a portion of a metallic, tubular member that protrudes from a distal end of a metallic shell and ranges axially from a distal end of the metallic, tubular member to the distal end of the metallic shell has an outside diameter smaller than that of a portion of the metallic, tubular member fixed to the metallic shell; and a distally facing end face is formed in such a manner as to serve as a boundary face between the portions of different outside diameters. In the glow plug, in addition to a distal end face of the metallic shell, a distal end face of a thick-walled portion of the metallic, tubular member can abut the annular seat face in the mounting hole, thereby solving the above-mentioned problem to a certain extent. In other words, the glow plug employs a mounting structure such that a peripheral portion of the distal end of the thick-walled portion of the metallic, tubular member is in direct contact with a dead-end portion (annular seat face) of the engine head, thereby providing good heat conduction efficiency as compared with the above-described glow plug disclosed in Japanese Patent Application Laid-Open No. 2001-324141, in which heat is conducted to the engine head via the metallic shell only.

However, in the glow plug disclosed in Japanese Patent Application Laid-Open No. 2002-276942, both the distal end face of the thick-walled portion of the metallic, tubular member and the distal end face of the metallic shell are in contact with the annular seat face in the mounting hole formed in the engine head. Therefore, the contact area between the metallic, tubular member and the annular seat face decreases by the contact area between the distal end face of the metallic shell and the annular seat face; consequently, direct heat conduction from the metallic, tubular member to the engine head becomes insufficient. A conceivable measure for rendering such direct heat conduction sufficient is to reduce the radial thickness of the distal end of the metallic shell. However, this will raise the following additional problem.

The glow plug is mounted as follows: the metallic shell is screwed into an internal-thread portion of the mounting hole such that the distal end face of the metallic shell is strongly pressed against the annular seat face in the mounting hole, whereby the metallic shell is positioned in a sealed condition. If the radial thickness of the distal end of the metallic shell is reduced, the strength of a distal end portion of the metallic shell against the press lowers, resulting in compressive deformation of the distal end portion or a like problem. In the case where, because of dimensional accuracy, the distal end of the metallic shell protrudes from the distal end face of the thick-walled portion of the metallic, tubular member, when the glow plug is screwed into an internal-thread portion of the mounting hole, the protruding distal end portion of the metallic shell is deformed by a compressive force (reaction force) from the annular seat face, and such a deformation impairs the reliability of seal.

Such a problem will not be involved if the distal end face of the metallic shell is situated rearward of the distal end face of the thick-walled portion of the metallic, tubular member such that, when the distal end face of the thick-walled portion is in contact with the annular seat face in the mounting hole, the distal end face of the metallic shell is located away from the annular seat face. However, in this case, since screwing the metallic shell into the engine head causes the distal end face of the thick-walled portion of the metallic, tubular member to be pressed against the annular seat face, the metallic, tubular member may slide (move) rearward in relation to the metallic shell. As a result, there arises a problem of a loose joint and a defective seal between the metallic shell and the metallic, tubular member.

SUMMARY OF THE INVENTION

The present invention has been accomplished in view of the above problems, and an advantage of the invention is a glow plug that can be mounted in an engine head through screwing a metallic shell into a mounting hole formed in the engine head without involvement of rearward slide of a metallic, tubular member relative to the metallic shell and such that a distal end face of a thick-walled portion of the metallic, tubular member abuts (is in press contact with), over a wide area, an annular seat face in the mounting hole, as well as to provide a structure for mounting the glow plug.

To achieve the above advantage, the present invention provides a glow plug in which a shaft-like heater including a resistance-heating element embedded in a distal end portion of the heater and adapted to generate heat when electrically energized is fixedly provided in a metallic, tubular member such that a distal end of the heater protrudes from a distal end of the metallic, tubular member; the metallic, tubular member is coaxially joined to a tubular, metallic shell such that the distal end of the metallic, tubular member protrudes from a distal end of the metallic shell; and an external-thread portion is formed on an outer circumferential surface of the metallic shell so as to allow the glow plug inserted into a plug-mounting hole formed in an engine head to be mounted in the engine head through screwing the external-thread portion into an internal-thread portion formed in the plug-mounting hole. In the glow plug, the metallic, tubular member comprises an annular protrusion formed on its outer circumferential surface in such a manner as to protrude radially outward and to annularly extend in a circumferential direction; and the metallic, tubular member is joined to the metallic shell while a distal end face of the metallic shell or a distally-facing end face of the metallic shell in the vicinity of the distal end of the metallic shell abuts a rearward-facing end face of the annular protrusion.

As mentioned above, a mounting hole formed in an engine head in which such a glow plug is to be mounted includes a threaded portion into which a threaded portion formed on the outer circumferential surface of a metallic shell is screwed. The mounting hole also includes an annular seat face (dead-end portion) located deeper than its threaded portion and having an inside diameter smaller than the thread diameter of its threaded portion. Conventionally, the glow plug is inserted and screwed into the mounting hole, whereby the distal end face of the metallic shell, or the distal end face of the metallic shell and the distal end face of a thick-walled portion of a tubular member are pressed against the annular seat face, thereby positioning the glow plug and maintaining gastightness. In the case of the glow plug of the present invention as well, the glow plug is screwed into a mounting hole similar to the conventional mounting hole. However, the distally-facing end face of the annular protrusion of the metallic, tubular member is pressed against the annular seat face in the mounting hole. Furthermore, since the distal end face of the metallic shell or the distally-facing end face of the metallic, shell in the vicinity of the distal end of the metallic shell abuts the rearward-facing end face of the annular protrusion, the metallic shell that is screwed in receives, via the annular protrusion, a reaction force that the distally-facing end face of the annular protrusion of the metallic, tubular member receives from the annular seat face at the time of the screwing operation. Therefore, according to the present invention, in mounting of the glow plug through screwing in of the metallic shell, the metallic, tubular member does not slide rearward in relation to the metallic shell. Furthermore, since only the distally-facing end face of the annular protrusion of the metallic, tubular member can be pressed against the annular seat face in the mounting hole, the contact area between the metallic, tubular member and the annular seat face can be increased. Notably, the distal end of the heater refers to an end (the bottom end in FIG. 1) of the heater on which side the embedded resistance-heating element is present; and the rear end refers to an end opposite the distal end. The distal end of the metallic, tubular member or that of the metallic shell refers to an end (the bottom end of each of the members in FIG. 1) located on the side toward the distal end of the heater; and the rear end refers to an end opposite the distal end.

As mentioned above, the glow plug of the present invention enables obtainment of a glow-plug-mounting structure characterized as follows: when the glow plug is screwed into the mounting hole for mounting, the metallic, tubular member does not slide in relation to the metallic shell; and the metallic, tubular member can be brought in contact with the annular seat face over a wide area. Therefore, heat of the heater can be efficiently transmitted to the engine head from the distally-facing end face of the annular protrusion of the metallic, tubular member via the annular seat face, which is formed in the mounting hole and is in contact with the distally-facing end face of the annular protrusion, thereby preventing an electrode portion of the heater from assuming an excessively high temperature. As a result, an increase in contact resistance between the electrode and a connection metal element can be reduced, thereby extending the life of the glow plug.

Preferably, the metallic, tubular member comprises a tubular portion extending coaxially rearward from the rearward-facing end face of the annular protrusion; and an inner circumferential surface of a distal end portion of the metallic shell is fitted to an outer circumferential surface of the tubular portion. Thus, the metallic, tubular member can be readily fitted to the metallic shell through press fitting, shrink fitting, or the like, thereby facilitating joining of the metallic, tubular member and the metallic shell.

Preferably, the annular protrusion comprises an annular flange portion formed on the outer circumferential surface of the metallic, tubular member in such a manner as to protrude radially outward, and a tubular portion extending coaxially rearward from an outer circumferential edge portion of the annular flange portion; and the metallic, tubular member and the metallic shell are joined such that an outer circumferential surface of a distal end portion of the metallic shell is fitted into an inner circumferential surface of the tubular portion, and the distal end face of the metallic shell abuts a rearward-facing end face of the annular flange portion. No particular limitation is imposed on the glow plug of the present invention, so long as the metallic, tubular member and the metallic shell are coaxially joined together such that the distal end of the metallic, tubular member protrudes from the distal end of the metallic shell. Therefore, the outer circumferential surface of a distal end portion of the metallic shell may be fitted into the inner circumferential surface of the tubular portion of the metallic, tubular member. Preferably, the annular protrusion comprises the annular flange portion formed on the outer circumferential surface of the metallic, tubular member in such a manner as to protrude radially outward, and the tubular portion extending coaxially rearward from an outer circumferential edge portion of the annular flange portion; and the metallic, tubular member and the metallic shell are joined such that an outer circumferential surface of a distal end portion of the metallic shell is fitted into an inner circumferential surface of the tubular portion, and a distally-facing end face of the metallic shell in the vicinity of the distal end of the metallic shell abuts a rearward-facing end face of the tubular portion.

Preferably, a distally-facing end face of the annular protrusion is tapered convergently in a distal direction. The distally-facing end face of the annular protrusion may be a plane perpendicular to the axis of the heater. However, through employment of such a taper converging in the distal direction and establishment of coincidence between the taper and that of the annular seat face in the mounting hole formed in the engine head, the contact area increases, thereby enhancing thermal conductivity.

Preferably, the distally-facing end face of the annular protrusion is located distally of two electrodes of the heater.

The distally-facing end face of the annular protrusion serves as a path for releasing to the engine head heat of the heater which would otherwise be conducted toward the rear end of the heater. Since the distally-facing end face of the annular protrusion, which serves as such a path, is disposed on the distal side of the electrodes, the electrodes can be efficiently prevented from assuming high temperature.

Preferably, the glow plug of the present invention further comprises a rotation-stop joint structure formed such that a protrusion is formed on at least one of two joint surfaces joining the metallic, tubular member and the metallic shell, and functioning such that, when the metallic, tubular member and the metallic shell are joined, one joint surface in contact with the other joint surface having the protrusion is deformed according to the protrusion to thereby prevent relative rotation between the metallic, tubular member and the metallic shell about an axis.

For screwing the external-thread portion formed on the outer circumferential surface of the metallic shell into the internal-thread portion formed in the mounting hole, an impact wrench is widely used. In screwing a glow plug into the mounting hole by use of an impact wrench, even after the distally-facing end face of the annular-protrusion of the metallic, tubular member abuts the annular seat face, the metallic shell is still subjected to a torsional torque. Specifically, after such abutment, while friction with the annular seat face causes the metallic, tubular member in contact with the annular seat face to stop rotating, the metallic shell is still subjected to torsion. Thus, if the joining strength of the metallic shell and the metallic, tubular member is weak, the metallic shell and the metallic, tubular member may undergo relative rotation about the axis and suffer loose joining. However, the glow plug of the present invention employs the rotation-stop joint structure, thereby avoiding the potential problem. Preferably, the protrusion of the rotation-stop joint structure is provided on the metallic, tubular member or the metallic shell, whichever is made of a harder material.

The present invention provides a glow-plug-mounting structure in which a glow plug of the present invention is mounted in the engine head such that the glow plug is inserted into the plug-mounting hole formed in the engine head, and the external-thread portion formed on an outer circumferential surface of the metallic shell is screwed into the internal-thread portion formed in the plug-mounting hole so as to press the glow plug against an annular seat face formed in the plug-mounting hole at a position located deeper toward an engine combustion chamber than the internal-thread portion and having an inside diameter smaller than an internal-thread diameter of the internal-thread portion, thereby positioning the glow plug and maintaining gastightness. In the glow-plug-mounting structure, the glow plug is mounted in the engine head such that the glow plug is screwed, via the external-thread portion, into the internal-thread portion in the plug-mounting hole formed in the engine head so as to press the distally-facing end face of the annular protrusion of the metallic, tubular member against the annular seat face in the plug-mounting hole.

DETAILED DESCRIPTION OF PREFERRED EMBODIMENT

Figure 1:
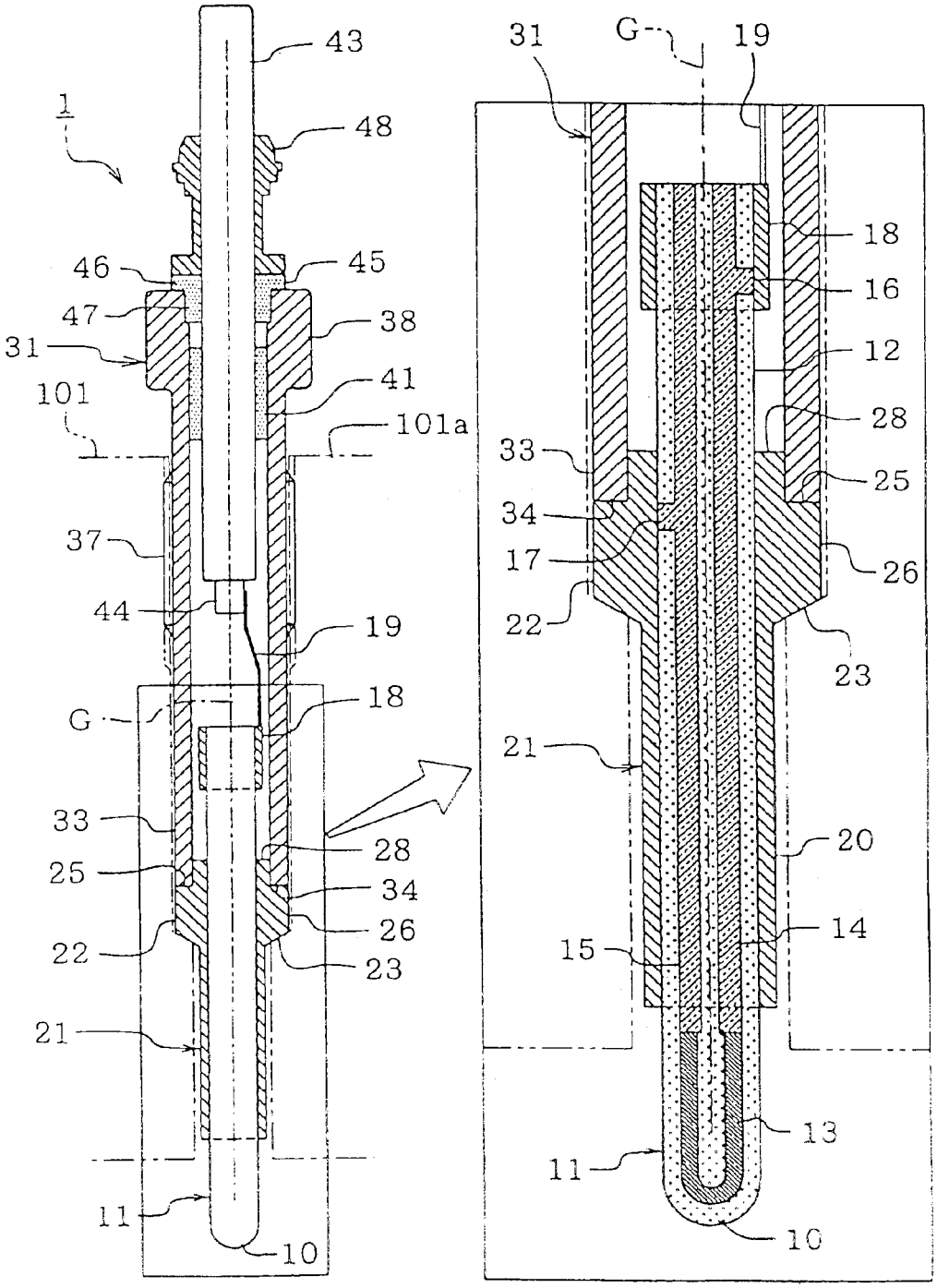
FIG. 1 is a sectional view showing a glow plug according to a first embodiment of the present invention, accompanied by an enlarged view showing a main portion of the glow plug.
Figure 2:
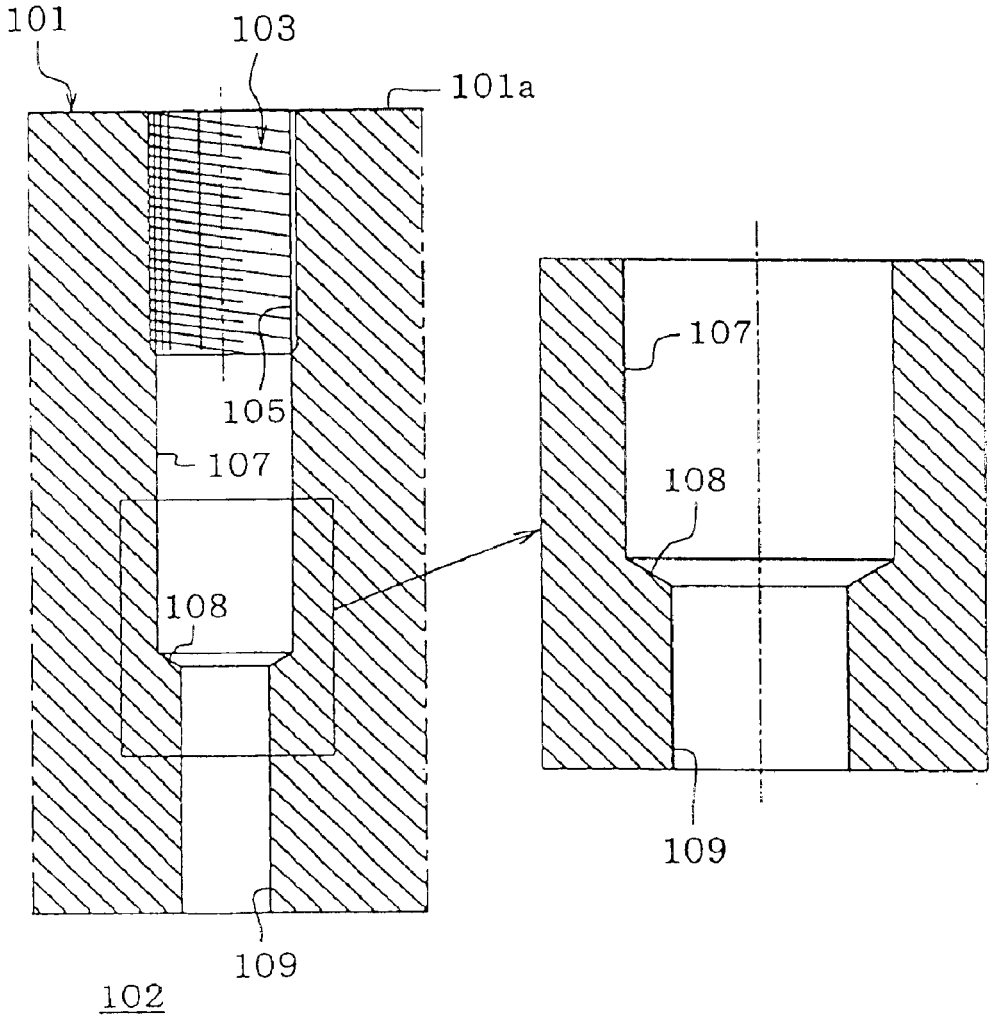
FIG. 2 is a sectional view for explaining a glow-plug-mounting hole formed in an engine head.
Figure 3:
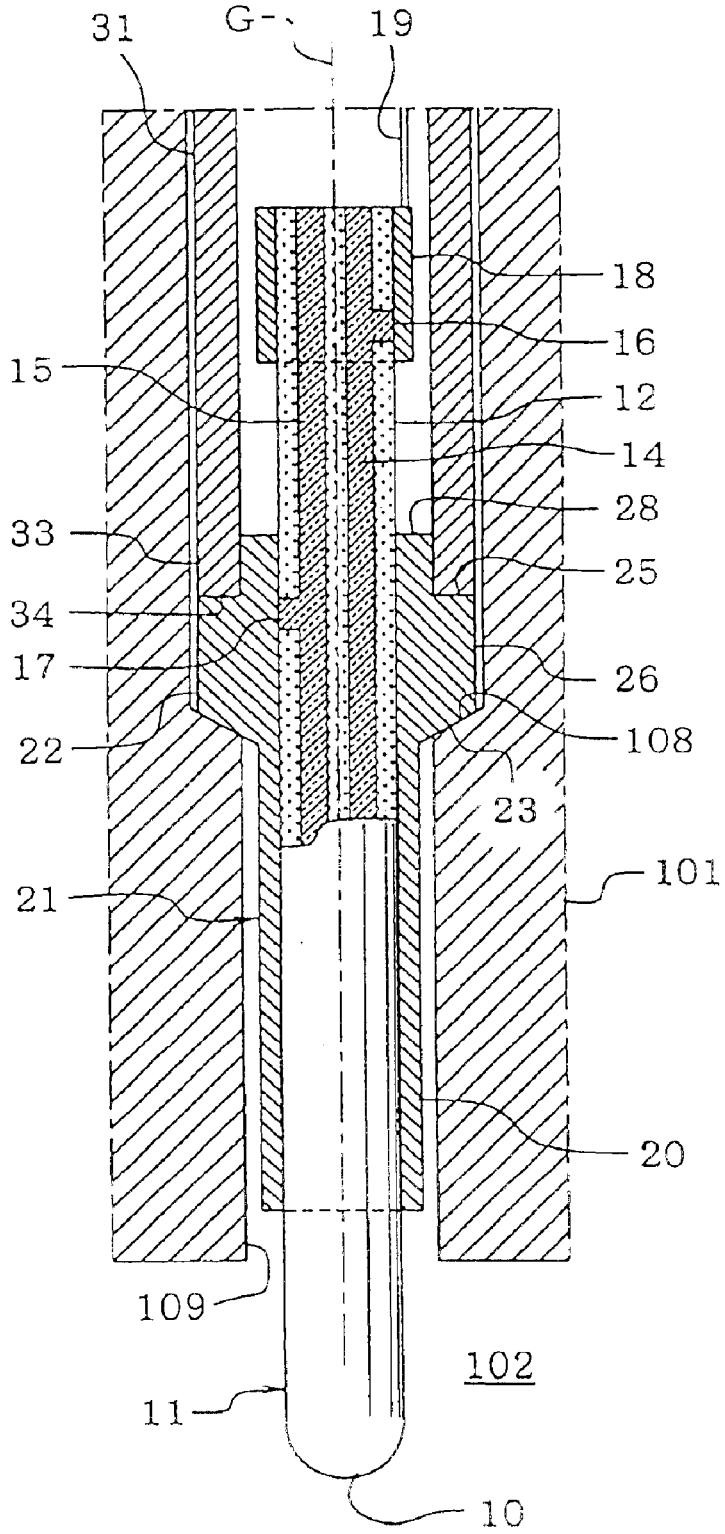
FIG. 3 is a sectional view showing the glow plug of FIG. 1 and a mounting structure of the glow plug.

A glow plug according to a first embodiment of the present invention will be described in detail with reference to FIGS. 1 to 3. A glow plug 1 of the present embodiment includes a shaft-like ceramic heater 11; a metallic, tubular member 21 in which the heater 11 is fixedly provided such that a distal end 10 of the heater 11 protrudes from the metallic, tubular member 21; and a tubular, metallic shell 31, which is externally fitted to a rear end portion of the metallic, tubular member 21 to thereby be coaxially joined to the metallic, tubular member 21.

The ceramic heater 11 assumes a shape of a circular column or round rod assuming a substantially constant diameter along the direction of axis G. A U-shaped resistance-heating element 13, which generates heat when electrically energized, is embedded in a distal end portion of an electrically insulative substrate (e.g., silicon nitride ceramic) 12 used to form the ceramic heater 11. Junction wires 14 and 15 are connected to corresponding opposite end portions of the resistance-heating element 13 in the electrically insulative substrate 12. An end portion of the junction wire 14 is exposed on the circumferential surface of a rear end portion of the heater 11, and a near-end portion of the junction wire 15 is exposed on the circumferential surface of a near-rear-end portion of the heater 11, whereby positive and negative electrodes (first and second electrodes) 16 and 17 are formed. A cylindrical, metallic terminal member 18 is shrink-fitted to the outer circumferential surface of a rear end portion of the heater 11 where the first electrode 16 is exposed, whereby the inner circumferential surface of the metallic terminal member 18 is brought in press contact with the first electrode 16, thereby establishing electrical continuity therebetween. One end portion of a lead wire 19 is connected to the metallic terminal member 18, and the other end portion is connected to a small-diameter, distal end portion 44 of a center rod 43 disposed coaxially in the metallic shell 31 via a ring-like insulator 41 and a gap.

The metallic, tubular member 21, which assumes a cylindrical shape having different outside diameters, is externally fitted to the heater 11 in the direction of axis G of the heater 11 through, for example, press fitting in such a manner as to cover the outer circumferential surface of an intermediate portion, with respect to the direction of axis G, of the heater 11, excluding distal end and rear end portions of the heater 11. Notably, a gap is maintained between the metallic, tubular member 21 and the above-mentioned metallic terminal member 18. The second electrode 17 is brought in press contact with the inner surface of the metallic, tubular member 21, thereby establishing electrical continuity therebetween. The metallic, tubular member 21 of the present embodiment includes an annular protrusion 22 that is formed on the outer circumferential surface of its rear end portion with respect to the direction of axis G in such a manner as to protrude radially outward in a flanging condition and to annularly extend in the circumferential direction. In this manner, the annular protrusion 22 forms a thick-walled portion of the metallic, tubular member 21. The annular protrusion 22 is formed as follows: as viewed on a sectional plane (an imaginary plane) including the axis G, a distally-facing end face (an end face facing downward in FIG. 1) 23 is tapered convergently in the distal direction; a rearward-facing end face 25 is perpendicular to the axis G; and an outer circumferential surface 26 is in parallel with the axis G. Thus, the distally-facing end face 23 assumes a taper surface; the rearward-facing end face 25 assumes a planar surface; and the outer circumferential surface 26 assumes a cylindrical surface. In the present embodiment, a tubular portion 28 coaxially extends rearward from the rearward-facing end face 25. The outside diameter of the tubular portion 28 is greater than that of a portion of the metallic, tubular member 21 excluding the annular protrusion 22; i.e., greater than the outside diameter of a cylindrical portion 20 distally extending from the annular protrusion 22. In the present embodiment, the distally-facing end face 23 of the annular protrusion 22 is located distally of the electrodes 16 and 17 of the heater 11. The electrode 17 is in press contact with the inner circumferential surface of a rear end portion of the annular protrusion 22.

In the present embodiment, the metallic shell 31 generally assumes a cylindrical shape. The interior of the metallic shell 31, excluding its rear end portion, extends straight and assumes a circular cross section. The inner circumferential surface of a distal end portion 33 of the metallic shell 31 is fitted to the outer circumferential surface of the rear-end, cylindrical portion 28 of the metallic, tubular member 21 through press fitting, shrink fitting, or the like. Notably, the metallic shell 31 is joined to the metallic, tubular member 21 such that a distal end face 34 of the metallic shell 31 abuts the rearward-facing end face 25 of the annular protrusion 22. In the present embodiment, the distal end portion 33 of the metallic shell 31 and the annular protrusion 22 assume the substantially same outside diameter, so that the outer circumferential surface of the distal end portion 33 aligns with the outer circumferential surface of the annular protrusion 22. In the present embodiment, the metallic shell 31 is formed of a steel material equivalent to S40C, such as JIS STKM16, whereas the metallic, tubular member 21 is formed of SUS430. However, appropriate metal materials may be used to form the metallic shell 31 and the metallic, tubular member 21.

The metallic shell 31 has such a length as to surround the center rod 43 up to an intermediate portion of the center rod 43, and, as mentioned previously, holds the center rod 43 via the ring-like insulator 41. An insulation ring 45 and a press fit ring 48 are provided at and rearward of a fear end portion of the metallic shell 31, respectively, in such a manner as to be externally fitted to the center rod 43. The insulation ring 46 is tightly attached to the metallic shell 31 by means of the external press fit ring 48 such that the lower surface of an upper-end flange 46 of the insulation ring 45 and an outer circumferential surface 47 extending downward from the flange 46 are pressed against the upper surface and the inner circumferential surface, respectively, of a rear end portion of the metallic shell 31, whereby the center rod 43 is fixedly attached to the metallic shell 31 while gastightness is maintained. As will be described in detail later, in order to screw the glow plug 1 into an engine head (cylinder head) 101 shown in FIG. 2, an external-thread portion (parallel thread) 37 is formed on the outer circumferential surface of an intermediate portion, with respect to the direction of axis G, of the metallic shell 31 so as to be screwed into an internal-thread portion 105 in a mounting hole 103 formed in the engine head 101. A rear end portion of the metallic shell 31 is formed into a hexagonal portion 38 for use in rotating the metallic shell 31 so as to screw in the glow plug 1.

As described above, as in the case of a conventional glow plug, the glow plug 1 of the present embodiment is inserted into the mounting hole 103 extending through the engine head 101 of a diesel engine up to a combustion chamber 102 and is screwed into the mounting hole 103 via the external-thread portion 37, to thereby be mounted in the engine head 101. The mounting hole 103 has the internal-thread portion 105 formed therein in such a manner as to extend inward from an outer surface 101*a* of the engine head 101, thereby allowing the external-thread portion 37 of the metallic shell 31 to be screwed into the internal-thread portion 105. The mounting hole 103 has a cylindrical hole 107 formed on the deeper side of the internal-thread portion 105, whereby the distal end portion (cylindrical portion) 33 of the metallic shell 31 can be loosely fitted into the cylindrical hole 107. The mounting hole 103 has an annular seat face 108 formed on the deeper side of the cylindrical hole 107. The annular seat face 108 has an inside diameter smaller than the internal-thread diameter of the internal-thread portion 105 and is tapered convergently toward a deeper side. The annular seat face 108 and the distally-facing end face 23 of the annular protrusion 22 of the metallic, tubular member 21 assume the same taper so as to abut each other. The mounting hole 103 has a cylindrical small-diameter hole 109 formed coaxially on the deeper side of the annular seat face 108. The cylindrical small-diameter hole 109 has a diameter smaller than that of the cylindrical hole 107 located on the side toward the exterior of the combustion chamber 102.

The glow plug 1 of the present invention is inserted into the glow-plug-mounting hole 103 from the distal end 10 of the heater 11, and the external-thread portion 37 of the metallic shell 31 is screwed into the internal-thread portion 105 in the mounting hole 103. The external-thread portion 37 is screwed in until the distally-facing end face 23 of the annular protrusion 22 is pressed against the annular seat face 108, whereby the glow plug 1 is mounted while being positioned and in a gastight condition, and the second electrode 17 is grounded (see FIG. 3). In this screwing operation, the distally-facing end face 23 of the annular protrusion 22 of the metallic, tubular member 21 is pressed against the annular seat face 108 and thus receives a reaction force from the annular seat face 108 to thereby be pressed rearward. However, in the present embodiment, since the distal end face 34 of the metallic shell 31 abuts the rearward-facing end face 25 of the annular protrusion 22, the metallic, tubular member 21 does not slide rearward in relation to the metallic shell 31.

Furthermore, a portion (surface) of the glow plug 1 that is pressed against the annular seat face 108 in the mounting hole 103 is only the distally-facing end face 23 of the annular protrusion 22 of the metallic, tubular member 21; i.e., only the distal end face of the thick-walled portion of the metallic, tubular member 21, thereby establishing a wide contact area between the metallic, tubular member 21 and the annular seat face 108. Therefore, heat of the heater 11 is transmitted to the metallic, tubular member 21 in contact with the outer circumferential surface of the heater 11, and to the engine head 101 via the distally-facing end face 23 of the annular protrusion 22 and the annular seat face 108 in the mounting hole 103, which face is in contact with the distally-facing end face 23, whereby heat is efficiently transmitted to the engine head 101. As a result, the present embodiment yields the following peculiar effect: a rear end portion or a near-rear-end portion of the heater 11 is prevented from assuming high temperature, thereby preventing an increase in contact resistance at the electrodes 16 and 17.

Figure 4:
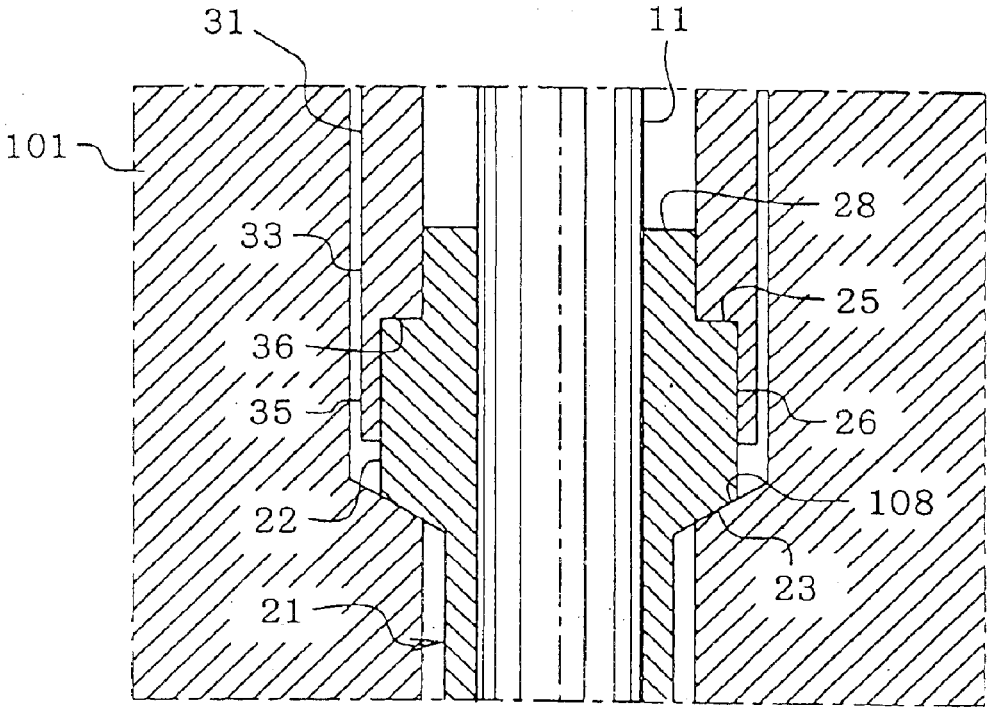
FIG. 4 is a sectional view showing a glow plug according to a second embodiment of the present invention and a mounting structure of the glow plug.

Next, a second embodiment of the present invention will be described with reference to FIG. 4. The present embodiment is substantially similar to the above-described first embodiment except that the structure for joining a distal end portion of the metallic shell 31 and the metallic, tubular member 21 differs slightly. Therefore, similar structural features are denoted by common reference numerals, and only different features will be described. The same convention also applies to other embodiments to be described below.

Also, in the present embodiment, the inner circumferential surface of the distal end portion 33 of the metallic shell 31 is fitted to the outer circumferential surface of the rear-end, cylindrical portion 28 of the metallic, tubular member 21. However, a thin-walled cylindrical portion 35 distally extends in the axial direction from an outer circumferential portion of a distally-facing end face 36, which is located in the vicinity of the distal end of the metallic shell 31 and corresponds to the distal end face of the metallic shell 31 of the first embodiment. The cylindrical portion 35 is externally fitted to the annular protrusion 22 of the metallic, tubular member 21 in such a manner as to cover the outer circumferential surface 26 of the annular protrusion 22; and the distally-facing end face 36 in the vicinity of the distal end of the metallic shell 31 abuts the rearward-facing end face 25 of the annular protrusion 22 of the metallic, tubular member 21, whereby the metallic, tubular member 21 and the metallic shell 31 are joined together. Notably, the distal end of the cylindrical portion 35 is designed to be located rearward of the distally-facing end face 23 of the annular protrusion 22.

As is apparent from the above description, in the present embodiment, as in the case of the first embodiment, heat of the heater 11 can be released from the distally-facing end face 23 of the annular protrusion 22 of the metallic, tubular member 21 to the engine head 101 via the annular seat face 108 in contact with the distally-facing end face 23. At the time of mounting through screwing, a reaction force that the distally-facing end face 23 receives from the annular seat face 108 presses the distally-facing end face 23 rearward. However, since the distally-facing end face 36 of the metallic shell 31 abuts the rearward-facing end face 25 of the annular protrusion 22, the metallic, tubular member 21 does not slide rearward in relation to the metallic shell 31. Therefore, the present embodiment yields effect similar to that of the first embodiment.

Additionally, since the cylindrical portion 35, which is a distal end portion of the metallic shell 31, covers the outer circumferential surface 26 of the annular protrusion 22 of the metallic, tubular member 21, spot welding from the outer surface of the cylindrical portion 35 can be used to join the metallic, tubular member 21 and the metallic shell 31, thereby facilitating the joining operation. Furthermore, in this case, joining strength can be enhanced. In the case where a required joining strength can be obtained through spot welding from the outer surface of the cylindrical portion 35, the cylindrical portion 28 extending rearward from the rearward-facing end face 25 of the annular protrusion 22 of the metallic, tubular member 21 may be eliminated. Notably, either loose fitting or shrink fitting such as press fitting may be used for externally fitting the cylindrical portion 35 to the annular protrusion 22.

Figure 5:
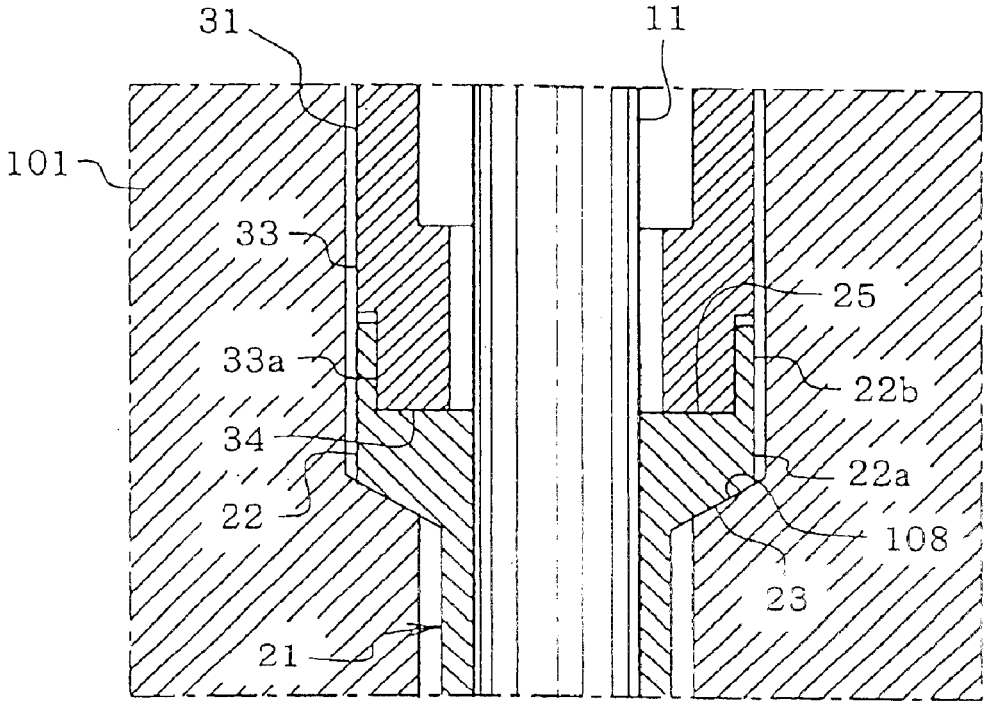
FIG. 5 is a sectional view showing a glow plug according to a third embodiment of the present invention and a mounting structure of the glow plug.

Next, a third embodiment of the present invention will be described with reference to FIG. 5. Since the present embodiment is also substantially similar to the above-described embodiments, only different features will be described.

In the present embodiment, the annular protrusion 22 includes an annular flange portion 22*a* formed on the outer circumferential surface of a rear end portion of the metallic, tubular member 21 in such a manner as to protrude radially outward, and a tubular portion 22*b* extending coaxially rearward from an outer circumferential edge portion of the annular flange portion 22*a*. An outer circumferential surface 33*a* of the distal end portion 33 of the metallic shell 31 is coaxial with and has a diameter smaller than that of the outer circumferential surface of a remaining portion of the metallic shell 31. The outer circumferential surface 33*a* of the distal end portion 33 of the metallic shell 31 is fitted into the inner circumferential surface (the inside) of the tubular portion 22*b* of the metallic, tubular member 21. In this fitting, the distal end face 34 of the metallic shell 31 abuts the rearward-facing end face 25 of the annular flange portion 22*a*. Notably, the small diameter, outer circumferential surface 33*a* of the distal end portion 33 of the metallic shell 31 and the inner circumferential surface of the tubular portion 22*b* of the metallic, tubular member 21 are joined together through press fitting, welding, or the like.

Figure 6:
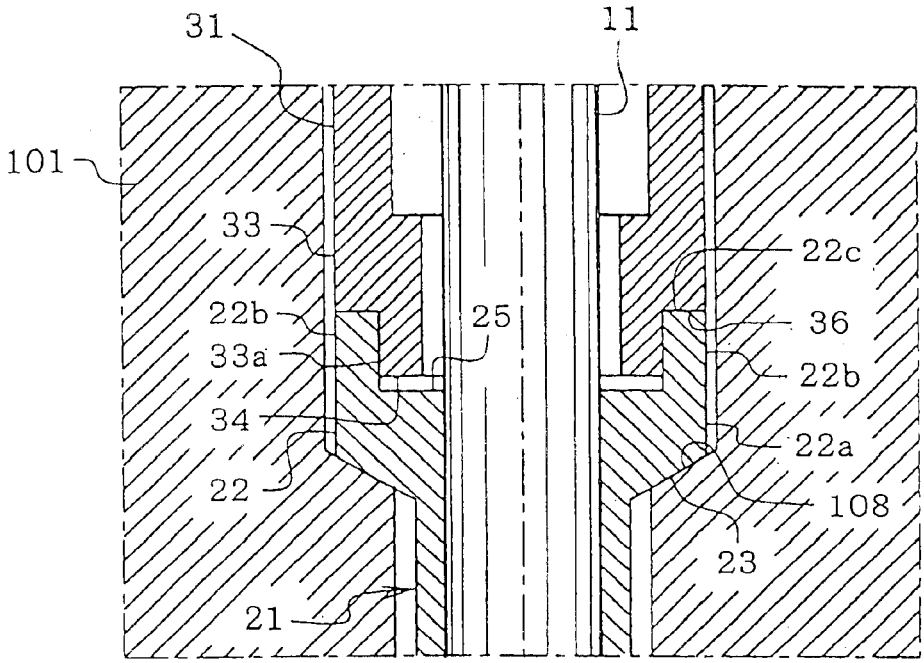
FIG. 6 is a sectional view showing a glow plug according to a fourth embodiment of the present invention and a mounting structure of the glow plug.

The present embodiment differs from the second embodiment only in that the outer circumferential surface 33*a* of the distal end portion 33 of the metallic shell 31 is fitted into the inner circumferential surface (the inside) of the tubular portion 22*b* of the metallic, tubular member 21. Also, in the case of the present embodiment, at the time of mounting in the mounting hole through screwing, a reaction force that the distally-facing end face 23 of the annular protrusion 22 receives from the annular seat face 108 presses the distally-facing end face 23 rearward. However, since the distally-facing end face 34 of the metallic shell 31 abuts the rearward-facing end face 25 of the annular protrusion 22, the metallic, tubular member 21 does not slide rearward in relation to the metallic shell 31. Also, as in the case of the second embodiment, heat of the heater 11 can be released from the distally-facing end face 23 of the annular protrusion 22 of the metallic, tubular member 21 to the engine head 101 via the annular seat face 108 in contact with the distally-facing end face 23. In FIG. 5, a gap is present between a distally-facing end face extending radially outward from the outer circumferential surface of the metallic shell 31 in the vicinity of the distal end of the metallic shell 31, and the rearward-facing end face of the tubular portion 22*b*. However, this gap may be eliminated; i.e., the distally-facing end face and the rearward-facing end face may abut each other. Also, as in the case of a fourth embodiment of the present invention shown in FIG. 6, the distally-facing end face 36 protruding radially outward from the outer circumferential surface 33*a* of a distal end portion (a portion in the vicinity of the distal end) of the metallic shell 31 may abut the rearward-facing end face 22*c* of the tubular portion 22*b* while a gap is formed between the distal end face 34 of the metallic shell 31 and the rearward-facing end face 25 of the annular protrusion 22.

Figure 7A:
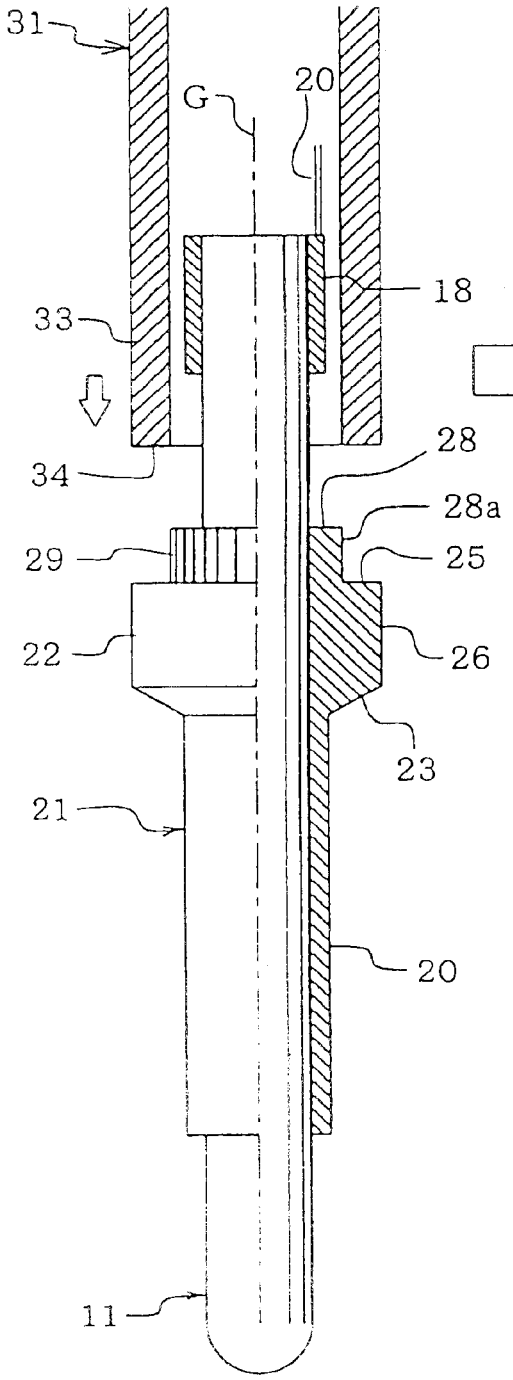
FIGS. 7A and 7B are sectional views for explaining a rotation-stop joint structure.
Figure 7B:
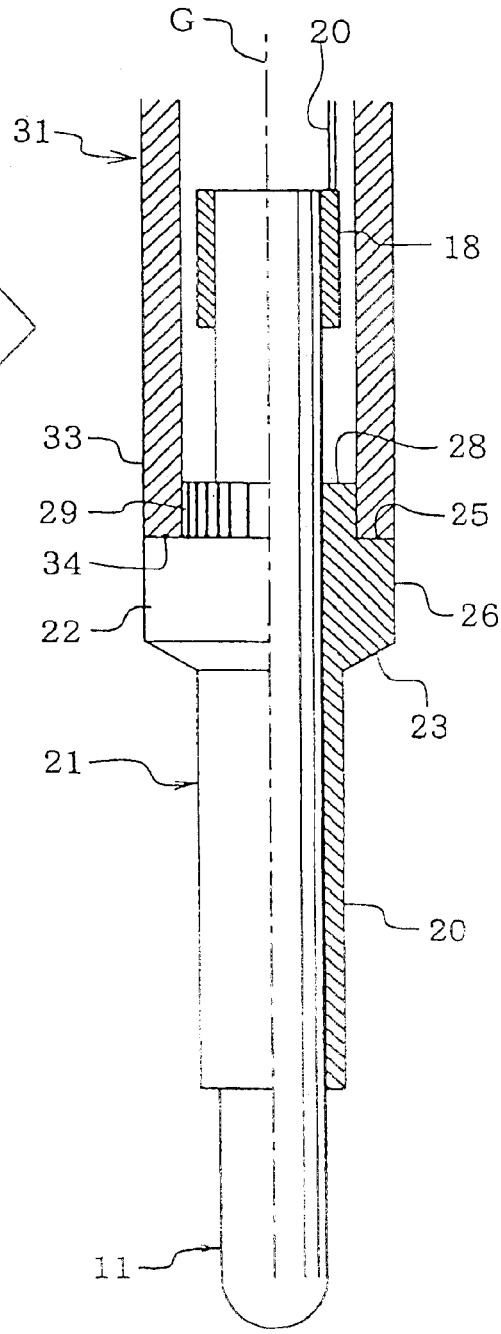

In the above-described embodiments, the metallic shell and the metallic, tubular member are joined together through press fitting, shrink fitting, welding, or the like. In the case where press fitting is employed, preferably, the glow plug includes a rotation-stop joint structure formed such that protrusions are formed on at least one of two joint surfaces joining the metallic shell and the metallic, tubular member, and functioning such that, when the metallic shell and the metallic, tubular member are joined, one joint surface in contact with the other joint surface having the protrusions is deformed according to the protrusions to thereby prevent relative rotation between the metallic, tubular member and the metallic shell about the axis. For example, in the above-described first embodiment, as shown in FIG. 7A, linear protrusions 29 extending in the direction of axis G are formed on an outer circumferential surface 28*a* of the rear-end; cylindrical portion 28 of the metallic, tubular member 21 before the metallic shell 31 and the metallic, tubular member 21 are joined together. As shown in FIG. 7B, the inner circumferential surface of the distal end portion 33 of the metallic shell 31 is fitted in a shrink fit condition to the outer circumferential surface 28*a* of the tubular portion 28 through press fitting or the like. This causes the linear protrusions 29 to partially bite into the inner circumferential surface of the distal end portion 33 of the metallic shell 31, thereby enhancing strength against torsion about the axis.

As mentioned previously, in the course of screwing the glow plug 1 into the mounting hole 103, after the distally-facing end face 23 of the annular protrusion 22 of the metallic, tubular member 21 abuts the annular seat face 108, friction with the annular seat face 108 causes the metallic, tubular member 21 in contact with the annular seat face 108 to stop rotating, whereas the metallic shell 31 attempts to rotate as a result of subjection to torsional torque. This may cause the metallic, tubular member 21 and the metallic shell 31 to suffer loose joining (relative rotation), potentially incurring defective seal. However, employment of the rotation-stop joint structure yields a peculiar effect of considerably reducing the potential occurrence of the problem. Notably, the above-mentioned linear protrusions extending in the direction of axis G may be formed through appropriate means such as knurling.

Figure 8A:
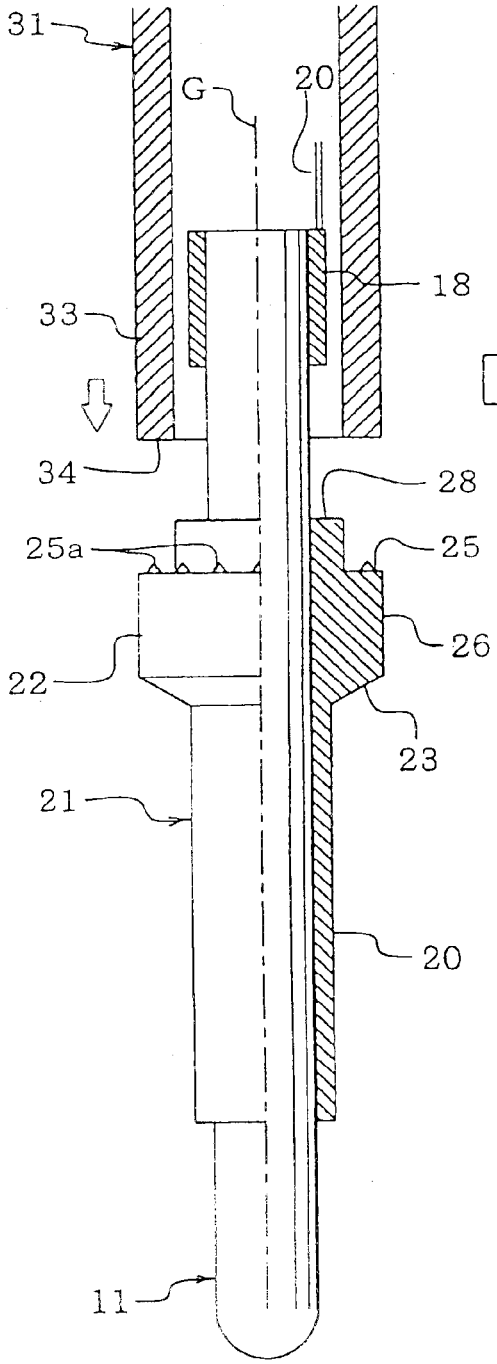
FIGS. 8A and 8B are sectional views for explaining another rotation-stop joint structure.
Figure 8B:
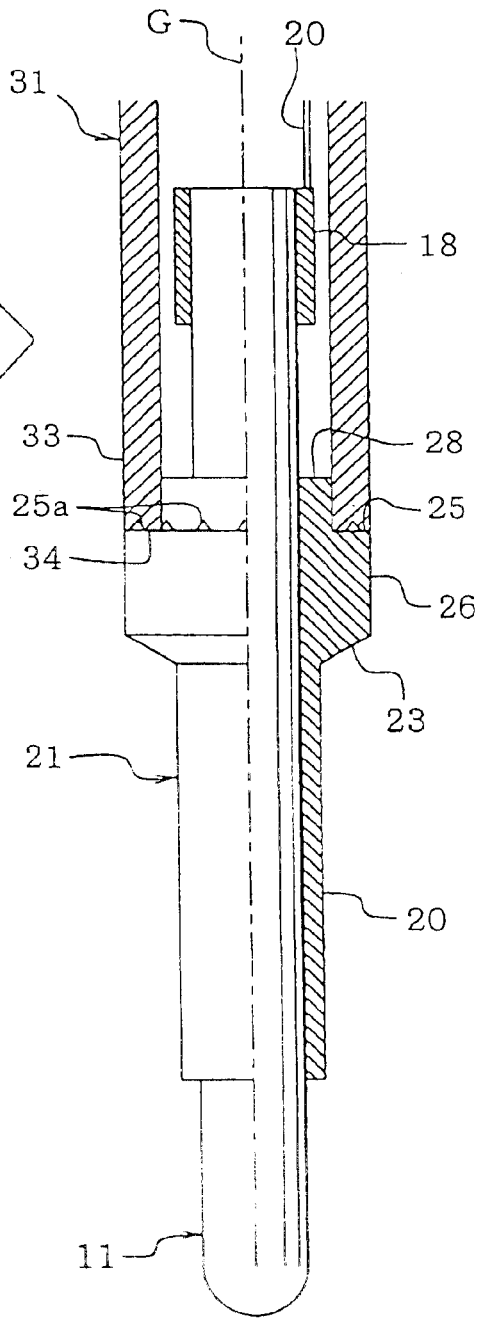

Such a rotation-stop joint structure can also be implemented as shown in FIG. 8A. Specifically, the joint surface of the metallic, tubular member 21; i.e., the rearward-facing end face 25 of the annular protrusion 22, consists of a flat surface (a plane) and protrusions 25*a*, each of which assumes a pointed shape such as a conical shape and is formed on the flat surface in a raised condition. On the other hand, the joint surface of the metallic shell 31; i.e., the distal end face 34, is a flat surface. When the metallic shell 31 and the metallic, tubular member 21 are joined through press fitting or the like, as shown in FIG. 8B, the protrusions 25*a* bite into the distal end face 34 of the metallic shell 31. Such a rotation-stop joint structure can also be implemented in the above-described second and third embodiments.

In FIGS. 8A and 8B, when the bite of the protrusions 25*a* is shallow, only a vertex portion of each of the protrusions 25*a* protruding from the rearward-facing end face 25 of the annular protrusion 22 bites into the distal end face (or a distally-facing end face in the vicinity of the distal end) 34 of the metallic shell 31. In this case, a gap is formed between the distal end face 34 of the metallic shell 31 and the flat surface portion of the rearward-facing end face 25 of the annular protrusion 22. In other words, respective vertex portions of the protrusions 25*a* of the rearward-facing end face 25 abut the distal end face 34 of the metallic shell 31.

In the above-described embodiments, excluding the embodiment shown in FIGS. 8A and 8B, the rearward-facing end face of the annular protrusion of the metallic, tubular member and the distal end face (or a distally-facing end face in the vicinity of the distal end) of the metallic shell are planes, and the planes entirely abut each other. However, the present invention is not limited to the entire, planar abutment between the rearward-facing end face and the distal end face (or a distally-facing end face in the vicinity of the distal end) of the metallic shell. For example, although unillustrated, the rearward-facing end face of the annular protrusion may be formed such that protrusions are arranged at certain intervals in the circumferential direction in a manner resembling a crown gear. In this case, when a mating face of abutment (the distal end face of the metallic shell or a distally-facing end face in the vicinity of the distal end of the metallic shell) is a plane, respective rearward-facing end faces of the protrusions of the rearward-facing end face of the annular protrusion abut the plane. Therefore, when the rearward-end face of the annular protrusion and the distal end face of the metallic shell abut each other, a gap is formed therebetween at portions between the protrusions of the rearward-facing end face. Alternatively, this may be reversed; specifically, the rearward-facing end face of the annular protrusion is a plane, whereas the distal end face (a mating face of abutment) of the metallic shell is formed such that protrusions are arranged at certain intervals in the circumferential direction in a manner resembling a crown gear. In the present invention, abutment between the rearward-facing end face of the annular protrusion and the distal end face (or a distally-facing end face in the vicinity of the distal end) of the metallic shell is intended to prevent rearward slide of the metallic, tubular member in relation to the metallic shell when the metallic shell is screwed for attachment. Furthermore, although unillustrated, both the rearward-facing end face of the metallic, tubular member and the distal end face of the metallic shell may be formed such that protrusions are arranged at certain intervals in the circumferential direction in a manner resembling a crown gear, so as to engage with each other when the metallic, tubular member and the metallic shell are joined together. This implements a rotation-stop joint structure even though the bite as shown in FIGS. 8A and 8B is absent.

The present invention is not limited to the above-described embodiments, but may be embodied in many other specific forms without departing from the spirit or scope of the invention. For example, in the above-described embodiments, the distally-facing end face 23 of the annular protrusion 22 of the metallic, tubular member 21, from which face heat of the heater 11 is transmitted to the annular seat face 108, is tapered convergently in the distal direction. However, the distally-facing end face 23 may be a plane perpendicular to the axis G, or a spherical surface. The distally-facing end face 23 may assume a shape corresponding to the annular seat face. Preferably, in order to prevent electrode portions of the heater from assuming high temperature, the annular protrusion is located distally of the electrodes.

What is claimed is:

1. A glow plug comprising:

a tubular, metallic shell having an external-thread portion formed on an outer circumferential surface of the metallic shell so as to allow the glow plug inserted into a plug-mounting hole formed in an engine head to be mounted in the engine head through screwing the external-thread portion into an internal-thread portion formed in the plug-mounting hole;

a metallic, tubular member coaxially joined to the metallic shell such that the distal end of the metallic, tubular member protrudes from a distal end of the metallic shell; and a shaft-like heater fixedly provided in the metallic, tubular member such that a distal end of the heater protrudes from a distal end of the metallic, tubular member, the heater including a resistance-heating element embedded in a distal end portion of the heater and adapted to generate heat when electrically energized, wherein the metallic, tubular member comprises an annular protrusion formed on its outer circumferential surface in such a manner as to protrude radially outward and to annularly extend in a circumferential direction; and the metallic, tubular member is joined to the metallic shell while a distal end face of the metallic shell or a distally-facing end face of the metallic shell in the vicinity of the distal end of the metallic shell abuts a rearward-facing end face of the annular protrusion).

2. A glow plug according to claim 1, wherein the metallic, tubular member comprises a tubular portion extending coaxially rearward from the rearward-facing end face of the annular protrusion; and an inner circumferential surface of a distal end portion of the metallic shell is fitted to an outer circumferential surface of the tubular portion.

3. A glow plug according to claim 1, wherein the annular protrusion comprises an annular flange portion formed on the outer circumferential surface of the metallic, tubular member in such a manner as to protrude radially outward, and a tubular portion extending coaxially rearward from an outer circumferential edge portion of the annular flange portion; and the metallic, tubular member and the metallic shell are joined such that an outer circumferential surface of a distal end portion of the metallic shell is fitted into an inner circumferential surface of the tubular portion, and the distal end face of the metallic shell abuts a rearward-facing end face of the annular flange portion.

4. A glow plug according to claim 1, wherein the annular protrusion comprises an annular flange portion formed on the outer circumferential surface of the metallic, tubular member in such a manner as to protrude radially outward, and a tubular portion extending coaxially rearward from an outer circumferential edge portion of the annular flange portion; and the metallic, tubular member and the metallic shell are joined such that an outer circumferential surface of a distal end portion of the metallic shell is fitted into an inner circumferential surface of the tubular portion, and a distally-facing end face of the metallic shell in the vicinity of the distal end of the metallic shell abuts a rearward-facing end face of the tubular portion.

5. A glow plug according to claim 1, wherein a distally-facing end face of the annular protrusion is tapered convergently in a distal direction.

6. A glow plug according to claim 1, wherein the distally-facing end face of the annular protrusion is located distally of two electrodes of the heater.

7. A glow plug according to claim 1, further comprising a rotation-stop joint structure formed such that a protrusion is formed on at least one of two joint surfaces joining the metallic, tubular member and the metallic shell, and functioning such that, when the metallic, tubular member and the metallic shell are joined, one joint surface in contact with the other joint surface having the protrusion is deformed according to the protrusion to thereby prevent relative rotation between the metallic, tubular member and the metallic shell about an axis.

8. A glow-plug-mounting structure in which a glow plug according to claim 1 is mounted in the engine head such that the glow plug is inserted into the plug-mounting hole formed in the engine head, and the external-thread portion formed on an outer circumferential surface of the metallic shell is screwed into the internal-thread portion formed in the plug-mounting hole so as to press the glow plug against an annular seat face formed in the plug-mounting hole at a position located deeper toward an engine combustion chamber than the internal-thread portion and having an inside diameter smaller than an internal-thread diameter of the internal-thread portion, thereby positioning the glow plug and maintaining gastightness;

wherein the glow plug is mounted in the engine head such that the glow plug is screwed, via the external-thread portion, into the internal-thread portion in the plug-mounting hole formed in the engine head so as to press the distally-facing end face of the annular protrusion of the metallic, tubular member against the annular seat face in the plug-mounting hole.

* * * * *